US005143571A

United States Patent [19]

Lacoste et al.

[11] Patent Number: 5,143,571

[45] Date of Patent: Sep. 1, 1992

[54] METHOD OF MOLDING A GOLF CLUB HEAD

[75] Inventors: Rene Lacoste, Paris, France; Catherine Lacoste de Prado, Madrid, Spain

[73] Assignee: Patentex S.A., Switzerland

[21] Appl. No.: 770,546

[22] Filed: Oct. 3, 1991

Related U.S. Application Data

[63] Continuation-in-part of Ser. No. 290,235, Dec. 22, 1988, abandoned.

[30] Foreign Application Priority Data

Dec. 24, 1987 [FR] France ..... 87 18147

[51] Int. Cl.[5] ..... B29C 45/36

[52] U.S. Cl. ..... 156/245; 156/77; 264/46.6; 264/253; 264/263; 264/278; 273/167 F; 273/169

[58] Field of Search ..... 264/278, 255, 263, 46.6; 273/169, 171, 173, 167 R, 167 F, 167 D; 156/77, 245

[56] References Cited

U.S. PATENT DOCUMENTS

| | | | |
|---|---|---|---|
| 3,556,532 | 1/1971 | Ballmer | 273/169 |
| 3,659,855 | 5/1972 | Hardesty | 273/173 |
| 4,326,716 | 4/1982 | La Coste | 273/167 R |
| 4,754,977 | 7/1988 | Sohm | 273/171 |

*Primary Examiner*—James Lowe

*Attorney, Agent, or Firm*—Marshall, O'Toole, Gerstein, Murray & Bicknell

[57] ABSTRACT

Method for reducing the weight of molded golf club heads without changing their shape. Cavities of appropriate length and volume are created in the molded heads, extending from the rear face towards the front face thereof. Despite the cavities, the heads achieve a good restitution of energy, a good mass distribution, a low level of vibrations, and a good sound.

18 Claims, 6 Drawing Sheets

METHOD OF MOLDING A GOLF CLUB HEAD

This is a continuation-in-part of application Ser. No. 07/290,225, filed Dec. 22, 1988, now abandoned.

This invention relates to molded heads for golf clubs and to a low-cost method of making such heads while improving the performance and/or durability of the clubs.

BACKGROUND OF THE INVENTION

The clubs used in the game of golf all into three types, i.e., woods, irons, and putters.

Woods are clubs having heads which were at one time made exclusively of wood, and even today are often made of wood. The driver of No. 1 club is general used for hitting a ball on a tee. It has the longest shaft, permitting the generation of maximum head speed. The other woods, generally called fairway woods, are numbered 2 to 5 and have progressively shorter shaft lengths, and progressively increasing slopes in the striking face of the head, permitting the ball to be more easily lifted from the ground while imparting more spin to it. The heads are also progressively smaller and heavier. The striking faces of wood clubs are not flat but slightly rounded with a horizontal curve called "bulge" and a vertical curve called "roll."

Irons have shorter shafts than those on woods, and heads which are usually made of metal.

Putters are used to roll the ball into the hole on the greens.

In all golf club heads, the part near the shaft is called the heel, the part away from the shaft is called the toe, and the part holding the shaft is called the hosel or the neck. The part hitting the ball is called the face and the part close to the ground is called the sole.

Concept A

Originally, in which will be referred to herein as Concept A, the shafts of all clubs were made of wood. The heads of woods were made of a wood called persimmon which had adequate hardness and resiliency to obtain good restitution of the energy of the players's swing with some damping of the shock at impact with the ball and an agreeable sound.

The iron and putter heads were forged blades of metal.

Concept B

At a later time, the best gold clubs were made in a way which is still used and which will be referred to as Concept B.

In Concept B, the shafts are made of steel tubing. The heads of the irons and putters are generally still made of forged steel, with an increase in the thickness of the lower and sometimes central part of the blade.

The wood heads of Concept B are much more complex than in the past. Persimmon becoming difficult to find and expensive, heads are also made from laminated blocks (with many thin layers of other types of wood and resins glued together). Inserts are incorporated in the middled of the face, the inserts being made of various plastic materials or aluminum essentially to protect the face. The sole of the head is protected by a metal plate.

Many golfers, including some of the best players, still use drivers with such heads despite certain problems inherent in Concept B.

First, the heads are costly to make, starting with the necessary care to produce the laminated material and to give it the proper shape. The insert can be molded, but cutting its place in the face necessitates careful work. Then it has to be attached with some bonding material and often also with screws. The face has to be modelled very accurately with adequate characteristics, relating to the degree of slope (loft), the radius in the vertical direction (roll) and the radius in the horizontal direction (bulge).

The location and adjustment with screws of the sole plate also require work and care, as well as the reinforcement of the wood neck around the shaft, generally with binding. The weight and balance of the head has often to be adjusted with pieces of lead or brass glued or screwed under the sole plate or at the back of the head. Last, the whole head must be tinted or painted and protected with several coats of varnish.

Despite the best varnishing, after less than a year of play, moisture can be absorbed, causing warping, cracking, and increased weight, thus changing the playing characteristics. If it is necessary to replace a driver, it is almost impossible to get the same degree of loft, roll, and bulge of the first club.

The most serious problem with Concept B is that the restitution of energy, response, wound and feel cannot be the same when the ball is not struck by the small insert in a wooden head, but by the wood on either side of the insert, or by the center of iron blades.

The current design of golf club equipment has been affected by two factors. The first is the general tendency to use lighter clubs, specially drivers, and the second is the appearance of lighter steel shafts or composite shafts formed of graphite and other fibers. The results is that it is possible to make drivers lighter than in the past, but with heavier heads, and also be use material of higher density that wood to produce such heads.

For these reasons, wood heads described above have now been replaced to a certain with hollow metal heads according to what is referred to as Concept C.

Concept C

The heads of Concept C are entirely made of metal. The driver heads do not need inserts and sole plates, and are much less costly to make and, except possibly for drivers, are more durable.

For small and heavy heads of shorter woods, i.e., 2–5, the metal wall around the internal void, and specially the face, may be thicker than for the larger and lighter heads necessary for the drivers. The restitution of energy, the accuracy, the control and the sound, without much vibration, of such heads, may explain why such metal woods, ie., 2–5, are very popular.

But, with the large void and the thinner metal walls of the larger and lighter heads of No. 1 or driver clubs, many players and especially the most skillful, complain that the direction and the length of their drives is too uncertain, that the sound, when the ball is struck, is disagreeable and that there is not, between the degree of this sound and the feel in the hands and the result of their shot, the same relationship, desirable for accuracy, which is obtained with the wood material of Concepts A and B. In addition, the heads of metal drivers are not durable. In a short time, the front face may be deformed by the impacts with the ball and the head must be replaced or the whole club must be discarded.

Concept D

As a result of the deficiencies of the clubs of Concept C, some manufacturers were led initially to consider heads molded in various plastics or resinous materials, sometimes reinforced with the same types of fibers which are successfully used in golf shafts. Such materials are naturally lighter than metal but their density is still too high to produce solid molded driver heads as large and as light as those desired by some players. Various solutions were tried and used to reduce the weight of the heads of Concept D.

It is interesting to note that, in U.S. Pat. No. 3,390,881 describing a head made up of a wooden core and an insert together covered by a layer of polyurethane molded about the core it is said that:

> Solid club heads molded from synthetic resins have been produced commercially, but by preferred standard of golf club performance they have not been satisfactory. Examples of these plastics are nylon, acrylonitrile-butadiene styrene copolymer and polycarbonates. Because the density of these plastics is greater (by over 100%) than that of wood, it has been necessary to incorporate a central cavity in the solid plastic head. Major disadvantages of this construction are that they do not produce the desired sound at impact and its characteristics in terms of distance are not as good as those of conventional wood club.

With the general high cost of composite materials and with the addition of a metal plate to close the cavities and protect the sole, such heads are not as cheap and durable as metal heads. The central cavity increases the moment of inertia of the head, helping ordinary players who do not hit the ball consistently near the center of the face. Such clubs produce a less disagreeable sound than do metal heads, but generally without as much restitution of energy as solid heads according to Concepts A and B.

The central cavity required in clubs of Concept D implies the existence of an aperture in the sole. Elaborate means including bonded pieces are usually necessary to reduce the weakening of the structure, and a metal sole plate cannot be avoided.

This characteristic of increased moment of inertia permits classifying irons and putters having a large central cavity in the rear face ("perimeter-weighted") with the woods of Concepts C and D. Such clubs produce the same results, i.e., more control and accuracy for beginners but less power than clubs with solid blades for good players.

The thin metal in the center of perimeter-weighted heads produces a characteristic high sound when a ball is struck, indicating a loss of energy restitution for perimeter-weighted irons. For putters, there is also a similar high sound quite different from the sound produced by the heads of woods.

Concept E

U.S. Pat. No. 4,326,716 discloses, in a Concept E, polyurethane polymer vulcanizate heads with various characteristics, some of which permit reproducing for wood clubs without an insert, the same or better restitution of energy than that obtained with a club having a solid persimmon head are good feel, control and sound when the ball is struck. At the same time, the characteristics of resistance to cuts, abrasion, and elongation of such heads permit the elimination of the metal sole plate and the binding required for reinforming the neck in Concepts A or B. In addition, the sound when the ball is hit has been found to be very agreeable. The final net result is the possibility of producing in a single molding operation a finished molded head with face lines and a correctly bored hosel without the costly hand operations required in Concept B.

It has been found that the best results in play are obtained with vulcanizates having densities of about 1.22 g/cc$^3$. These densities cause no problem for heads of No. 2 to 5 "woods"clubs, for which the necessary high weights are easily obtained using screws in the bottom of the clubs, in which the resiliency of the polyurethane heads helps to keep the screws in place. But, for a driver, having a typical volume of 176 cm$^3$ (and an apparent volume of 181 cm$^3$ including a 5 cm$^3$ volume for the shaft hole), the high density of polyurethane results in a weight of about 215 g for the head. While a head weight of 215 g can be used to produce excellent clubs with composite shafts, it is too high to permit low enough swingweights in clubs having long steel shafts, which are still used by the best players.

In order to keep the weight of the head within acceptable limits for use with metal shafts, it may be necessary to reduce the volume of the molded heads to about 64 cm$^3$, corresponding to a weight of 200 g. While such a head has the volume of some good metal heads, the relatively small size may be considered a disadvantage in comparison with the larger wooden heads according to Concept B which some players believe to be desirable.

SUMMARY AND OBJECTS OF THE INVENTION

Concept F

The present invention, referred to as Concept F, concerns golf club heads molded with polyurethane polymers, optionally including graphite and other fibers or other materials. Although the invention is most pertinent to drivers, it is also applicable to iron and- putter heads and even some "fairway wood" heads.

An object of the invention is to reduce the weight of the head, during molding, to various levels required for obtaining club characteristics suitable for satisfying the different categories of golfers, including men as well as women, and beginners as well as expert golfers. The invention achieves its results by creating cavities extending from the rear face of the head towards its front face, up to a set distance from said front face, without changing the shape or diminishing the predetermined volume of said head. In a preferred embodiment, the cavities are sealed with a light and durable substance.

Another object is to produce clubs having, despite said cavities, a good restitution of the energy of the stroke, producing good distance for shots made with the clubs.

A third object is to obtain a low level of vibrations and an agreeable sound when the head of a driver strikes the ball, as close as possible to the sound obtained with solid persimmon heads.

A fourth object is to obtain a good mass distribution with an increase of moment of inertia and a well-placed center of gravity to reduce the poor results, i.e., slices or hooks, and short length of drives often experienced when the ball is struck by the face of the head near the heel or the toe.

A fifth object is to obtain a very low level of vibrations for iron and putter heads with more accuracy and a good sound.

The sixth object is to achieve all of the above objects with low manufacturing cost and good durability.

The invention will be better understood from the description which follows taken in conjunction with the accompanying drawings, in which the same numerals are used to represent the same or similar elements in the several views.

DESCRIPTION OF PREFERRED EMBODIMENT

Figure 1:
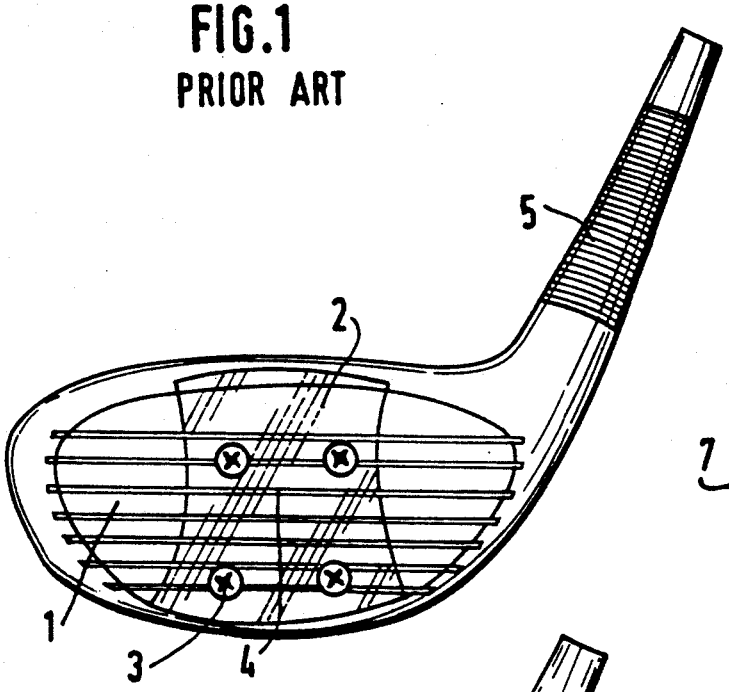
FIG.1 PRIOR ART
FIG. 1 is a view of the front face 1 of a commercial wooden driver head typical of Concept B, heaving an insert 2 held by screws 3, with score lines 4 and binding 5 around the neck.
Figure 2:
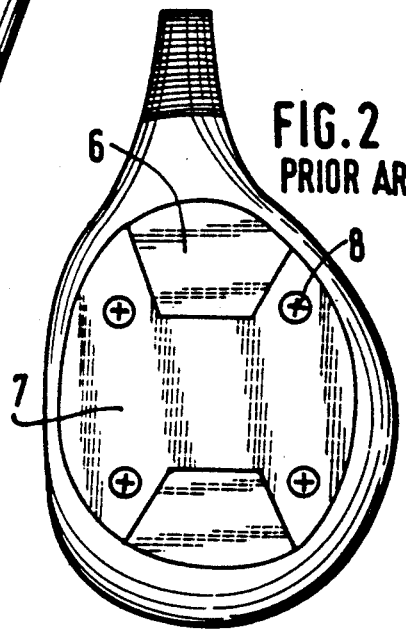
FIG.2 PRIOR ART
FIG. 2 is a bottom view of the sole 6 of the head of FIG. 1, showing a metal sole plate 7 held by screws 8.
Figure 3:
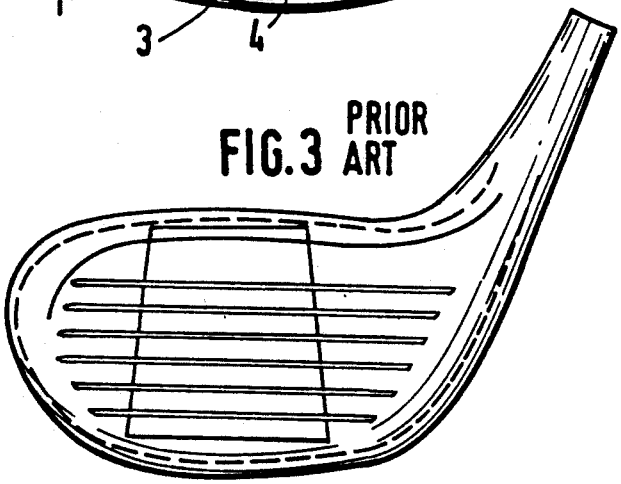
FIG.3 PRIOR ART
FIG. 3 is a view of the front face of a commercial metal head typical of Concept C, showing in dotted outline the large interval void.
Figure 4:
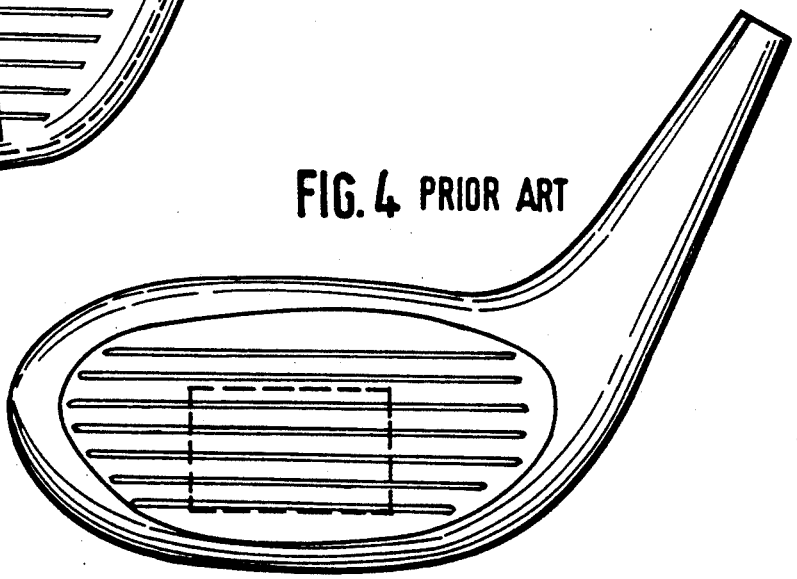
FIG.4 PRIOR ART
FIG. 4 is a view of the front face of a commercial graphite head typical of Concept D, showing in approximative dotted outline its internal void.
Figure 5:
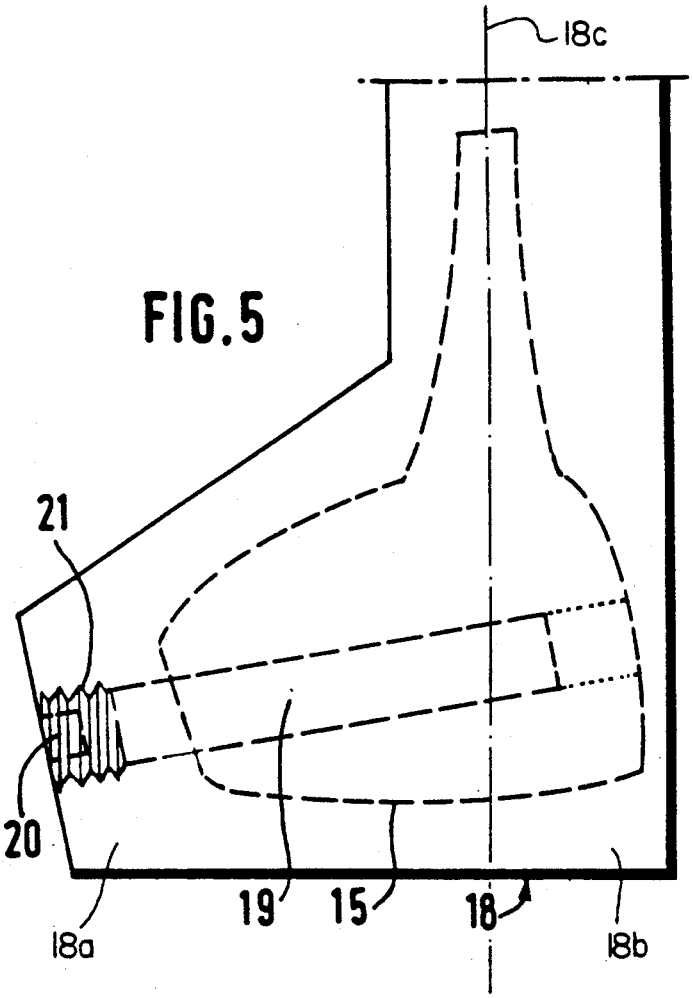
FIG. 5 is a schematic representation of a mold 18 having an internal void 15 corresponding to the toe view of a polyurethane head typical of Concept F, and a cylinder 19 creating a cavity during molding.
Figure 8:
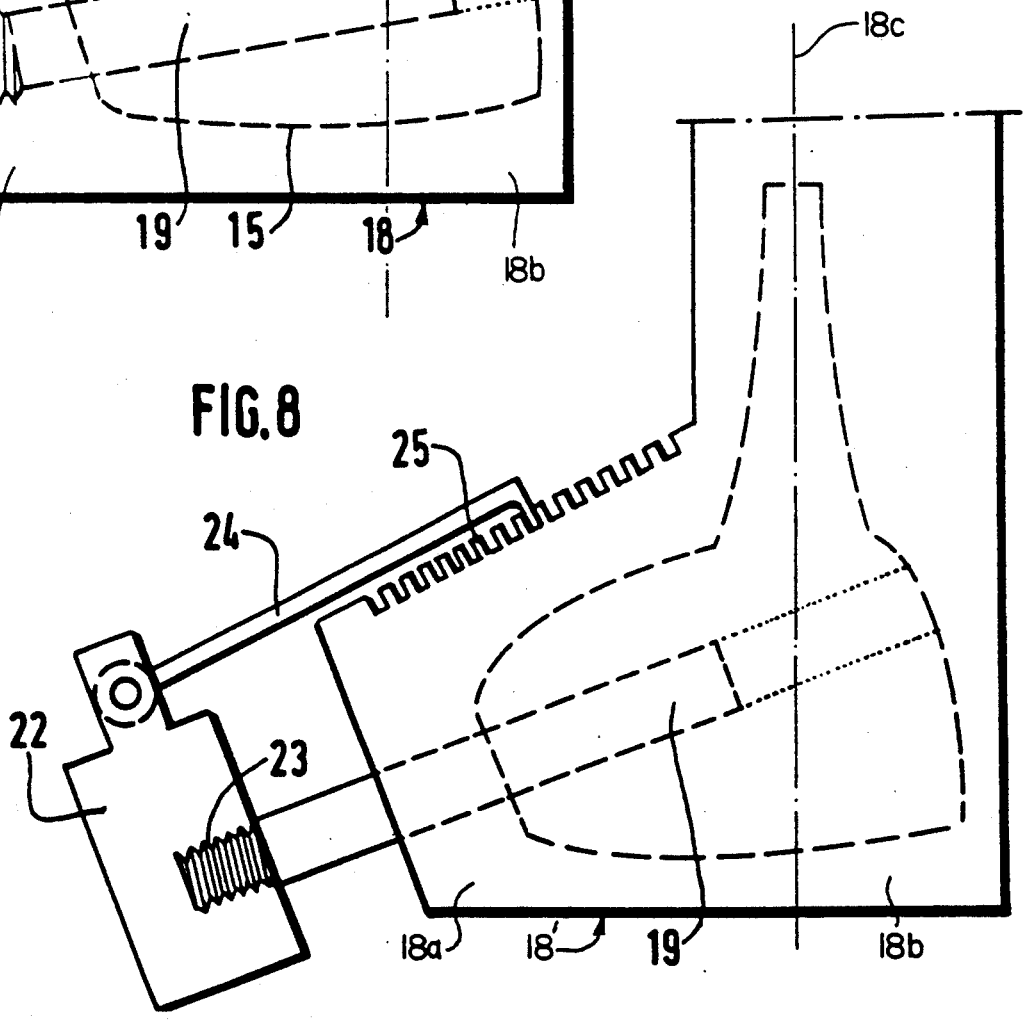
FIG. 8 is a view of a mold similar to that of FIG. 5, showing a clamp and latching means for holding a cylinder 19 during the molding operation.

In accordance with the invention, a driver head is molded using a mold 18 or 18' having an internal void 15 such as those shown in FIGS. 5 and 8. The mold sections **18*a* and 18*b* can be separated along partition line 18*c*** to release the molded head after the molding operation.

A typical mold may have an internal void volume of about 176 $cm^3$ and will produce a solid head weighing about 215 g from a polyurethane polymer having a density of 1.22 $g/cm^3$.

Using the molds of FIGS. 5 and 8, it is possible to produce heads in which the weight is reduced to any desired level down to about 198 g. or lower, which is low enough to produce a DO swing weight for a club assembled with a 43½-inch True Temper S 400 steel shaft for use by the strongest players. In the mold shown in FIG. 5, three holes having an appropriate diameter are pierced in the rear portion **18*a* of the mold corresponding to the rear face 14 of the head shown in FIG. 6. Three cylinders 19, only one of which is shown in FIG. 5, having a diameter of about 1.20 cm, are introduced in the mold void. The cylinders 19 are provided with slightly enlarged threaded ends 21 which engage similarly threaded holes in the wall of the mold. An appropriate, e.g., square, hole 20 is provided in the ends of cylinders 19** to facilitate insertion and removal of the cylinders by means of a suitable driver. The polymer is introduced in the mold in the conventional manner (not shown) and fills the void around the said three cylinders.

Figure 6:
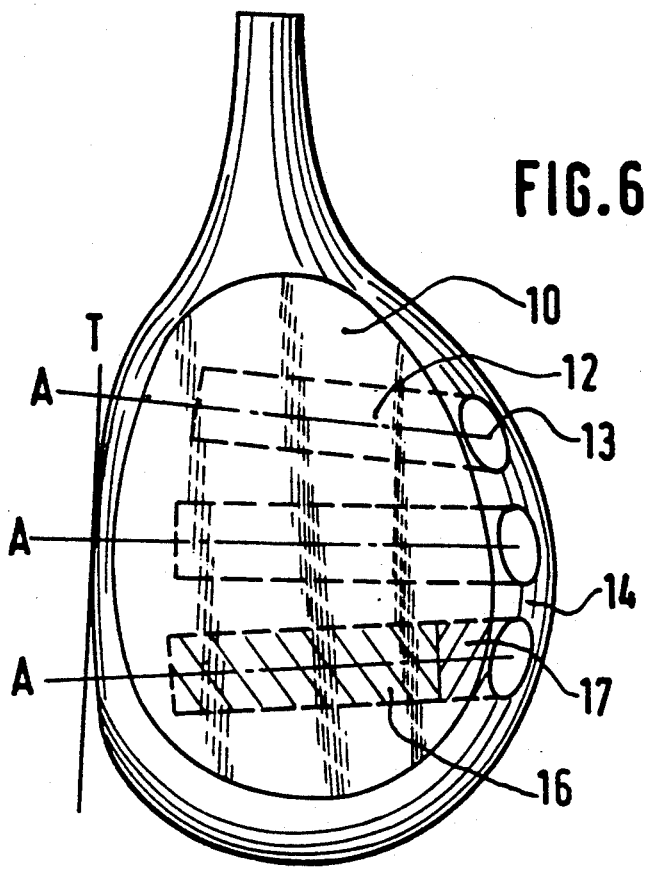
FIG. 6 is a view of the sole of a molded head 10 produced in accordance with the invention, using the mold of FIG. 5, showing cavities 12 having apertures 13 in the rear face of the head, and foam 16 and epoxy 17 in one cavity.
Figure 7:
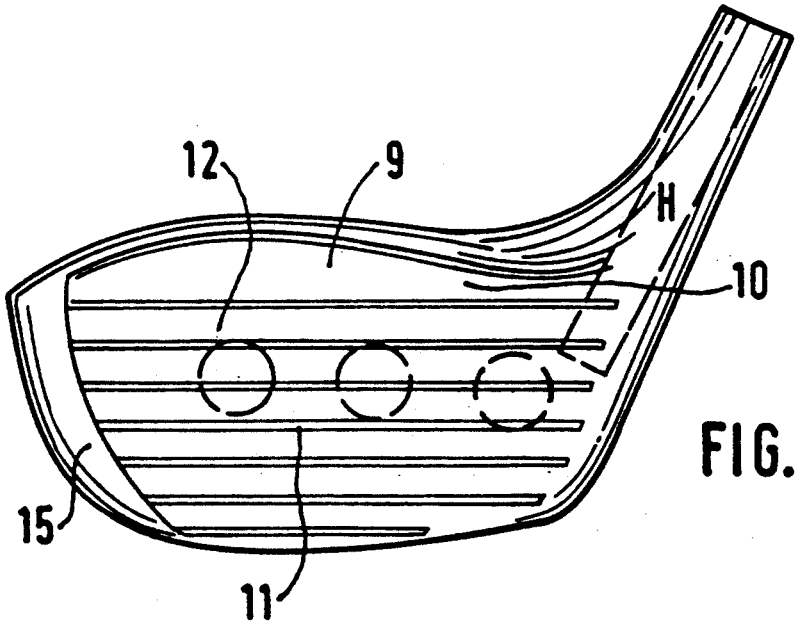
FIG. 7 is a view of the front face 9 of the head of FIG. 6, showing in dotted outline the position of the ends of the cavities 12 closest to the front face, and the hole H for the shaft.

After molding, the three cylinders 19 are unscrewed and withdrawn, leaving three cavities 12 having a 1.20 cm diameter in the molded head directed towards the middle of the front face of the head, as shown in FIGS. 6 and 7. The axes of the cavities are approximately perpendicular to the front face but, because of the bulge of said face, they are not parallel, but diverging. It is only the middle cavity which has an axis directed in the direction of motion of the club head when it strikes the ball.

The reduction in the weight of the molded head from the maximum weight determined by the interior void is controlled by the number of cylinders 19 and the length to which they protrude into the interior of the mold.

For example, if cylinders 19 enter the mold up to 1.5 cm from the inside front of the mold, and have an average length of 4.5 cm, the total volume of the three cavities 12 shown in FIG. 6 is about 15.2 $cm^3$ leading to a weight reduction of about 18.6 g.

Assuming a separation of about 0.5 cm between the apertures 13 of the cavities on the rear face 14 of the head in FIG. 6, the mass distribution is excellent, with the center of gravity behind the middle of the front face. To obtain drives with special trajectories, it is naturally possible to provide a slightly different mass distribution by altering the position of the cavities. However, the direction of the cavity axis nearest to the heel implies that said cavity is in the path of the hole H of the shaft which cannot be extended down near the sole, as shown in FIG. 7.

Since cavity apertures 13 must be closed for practical reasons, a great advantage is obtained by the position of the said apertures in the rear face 14 of the head, which is not submitted to any shock or pressure, as shown in FIG. 6.

As also shown in FIG. 6, each cavity 12 can be partly filled with low density polyethylene foam 16, leaving less than 0.5 cm above said foam to deposit, for instance, a layer of epoxy 17, having the same density (1.22) as polyurethane, to obtain a very strong closing with a total weight of 2.43 g. to achieve in the end a weight reduction of about 16.2 g. Alternatively, the layers of epoxy can be replaced by small molded cylinders of polyurethane bonded in the apertures 13. In this embodiment, various head weights between 214.7 and 198.5 g. can be obtained by changing the length of the cylinders, thus achieving the first and fourth objects of the invention with lower weight, higher moment of inertia and good mass distribution.

The production of club heads using a mold as shown in FIG. 5 is not entirely satisfactory, since it takes time to adjust the cylinders 19 individually as required to obtain different levels of weight reduction, and to insert and remove them for each head which is molded. For these reasons, the mold shown in FIG. 8 is preferable.

In an alternative preferred method using a mold as shown in FIG. 8, the cylinders 19 are lengthened sufficiently to be held in a separate steel block 22 by their ends 23. In this method, to permit said cylinders to enter the mold holes together, their axes A' (FIG. 10) must be absolutely parallel, said parallel axes A' being also the axes of said holes in the mold and of the cavities 12 which are produced in the molded heads. In this embodiment, the cylinders 19 enter the interior of the mold a distance controlled by engagement of a latch 24 with one of a series of notches 25 in the top of the mold. Using this embodiment, individual placement and removal of the cylinders in the mold are eliminated.

Figure 9:
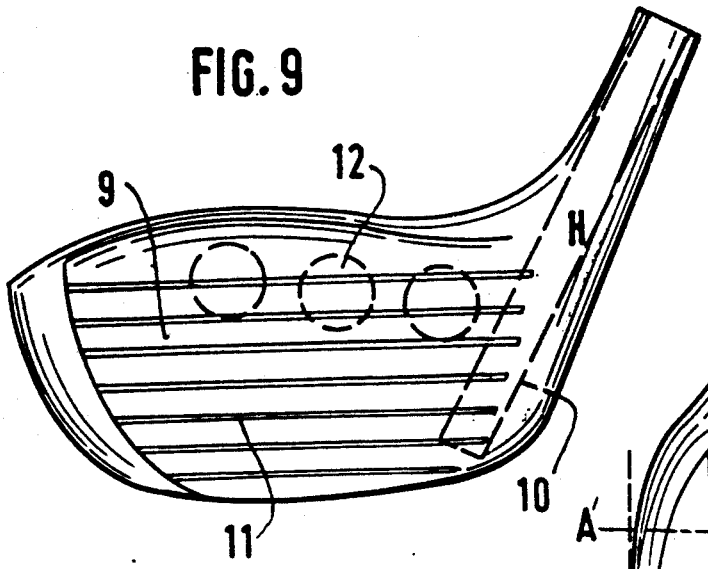
FIG. 9 is a view of the front face of the head produced using the mold of FIG. 8, with the cavities 12 placed higher in the front face.
Figure 10:
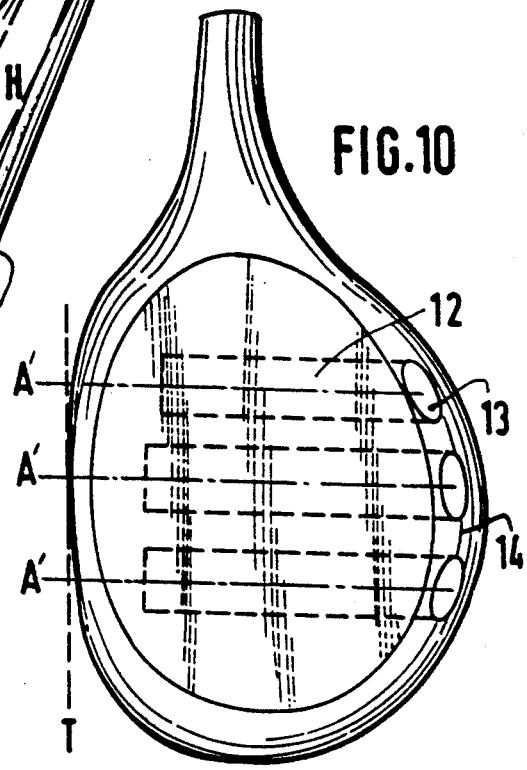
FIG. 10 is a view of the sole of the head of FIG. 9, showing cavities 12 in parallel relationship.
Figure 11:
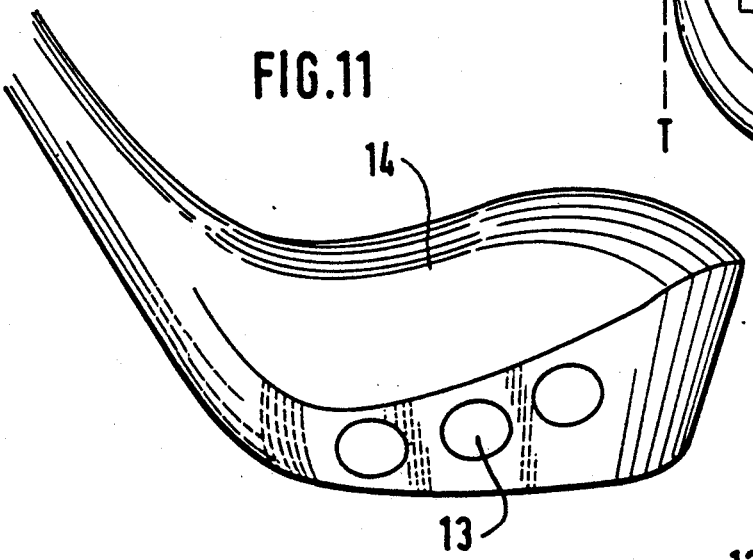
FIG. 11 is a view of the rear face 14 of the head of FIG. 10 showing the apertures 13 of the cavities 12.
Figure 12:
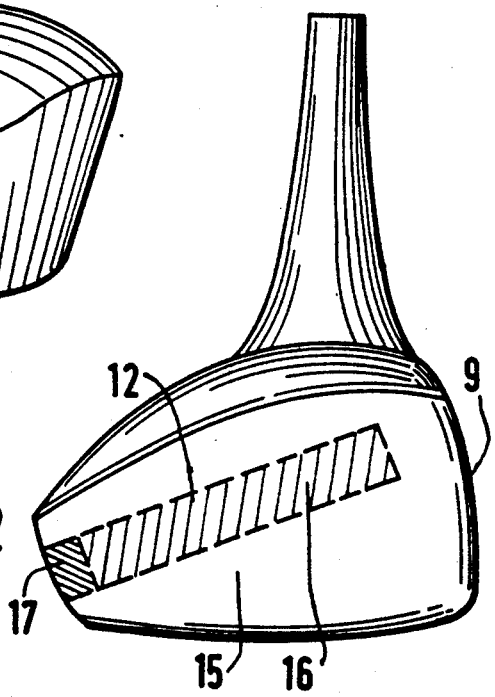
FIG. 12 is a view of the toe of the head of FIG. 9, showing in dotted outline one of the cavities 12 partly filled by foam 16 and closed by epoxy 17.

FIG. 10 shows a molded driver head in which said axes A' are not only parallel, but also located in planes which are also parallel and perpendicular to the horizontal tangent T drawn in the center of the front face. Said axes are also directed upwards as shown in FIG. 12. The cavity 12 nearest to the heel is not in the path of the hole H (FIG. 9) for the shaft, which can be extended down near the sole thus achieving greater strength in the assembly between the head and the shaft. Practically, said axes A' point in the same direction as the stroke.

Cavities 12 end at between 1 and 1.5 cm from the front face and between 0.5 and 1 cm from the top face, permitting a maximum weight reduction of about 18–19 g., i.e., a head weight of about 196–197 g. before closing the cavities. Typically, there is a separation of about 0.5 cm between the cavities, producing partitions extending from the rear face of the head towards the front face and, like said cavities, directed in the direction of the player's stroke. There is a greater thickness of molded material behind the front face between the ends of the cavities and the sole of the head than between said cavities and the top face of the head.

It was surprisingly found that, despite the existence of cavities, the heads of FIGS. 9–12 produced restitution of the energy in the stroke of a player which was much better than that obtained with the heads shown in FIGS. 6 and 7. The ball trajectories obtained with heads shown in FIGS. 9–12 exceeded in height and length the trajectory obtained with solid heads of same weight and face characteristics molded with the same polyurethane. When the loft of the heads made according to the invention was reduced from 12 to 10 degrees, the spin imparted to the ball was reduced and the trajectory became the same as with solid heads but the roll of the ball after impact with the ground was lengthened, the total length of the drives played with heads of Concept F shown by FIGS. 9, 10, 11, and 12 exceeding the length obtained with solid heads.

With these goods results obtained despite the cavities, with the ball well struck by the center of the front face of the head, it was less surprising, but as usefully found that, thanks to the same moment of inertia and mass distribution as in the first embodiment (FIGS. 6 and 7), the results are also very good, with few sliced or hooked shots and enough length when the ball is struck off center, too near the heel or the toe. Since the direction of the axis of the cavities 12 being the same as the direction of the stroke, the vibrations which are created are already low before being damped by the foam in the cavities. In addition, the sound is very close to the sound obtained with persimmon heads.

The level of weight reduction in accordance with the invention can be adjusted not only by the number and the length of the cavities 13, but also by the length of light foam 16 in said cavities and the proportion between said length of said polyethylene foam and the length of the epoxy or other resin which is used to fill the cavities.

For the best results, if the length of foam is small, the cavities can be closed with a polyurethane polymer having a shore D hardness slightly less than that of the resin used to mold the head, but with damping properties about ten times greater. Naturally, the polyethylene foam and the above damping polyurethane foam can be replaced by other materials with the same characteristics.

Figure 13:
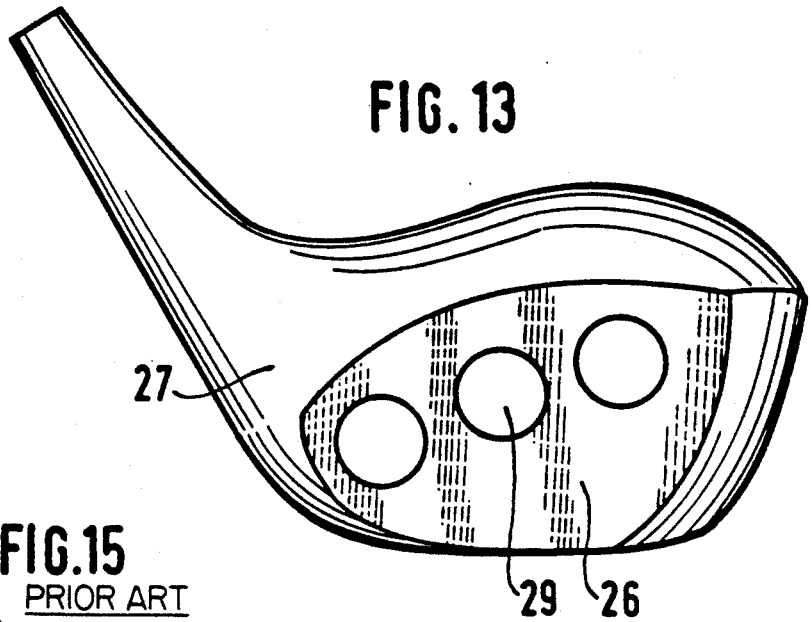
FIG. 13 is a view of another form of molded head 27 having a flat rear face 26, and the apertures 29 of its three cavities.
Figure 14:
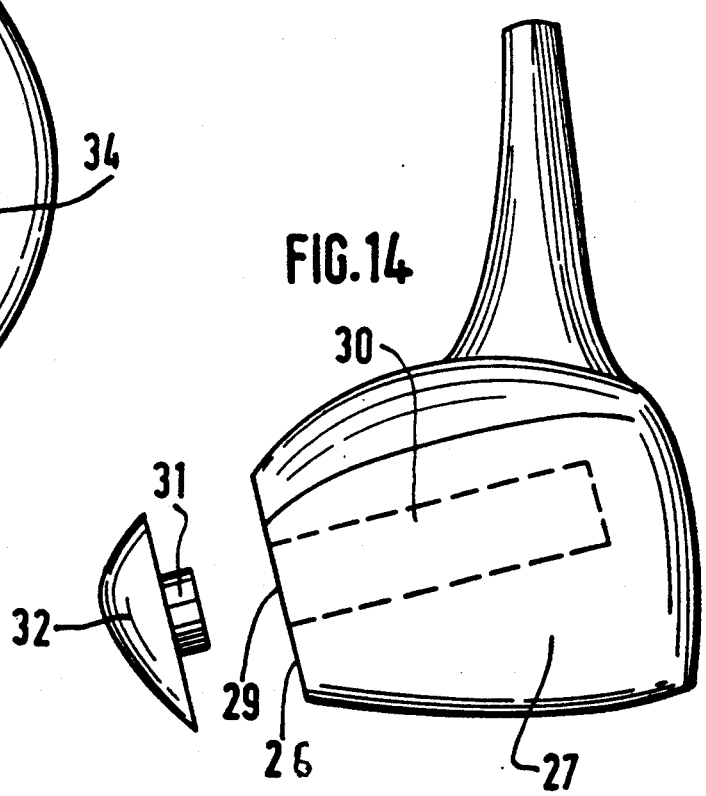
FIG. 14 is a toe view of the head 27 of FIG. 13, showing an independent molded piece 32 having a small cylinder 31 adapted to enter the aperture 29 of a cavity 30.
Figure 16:
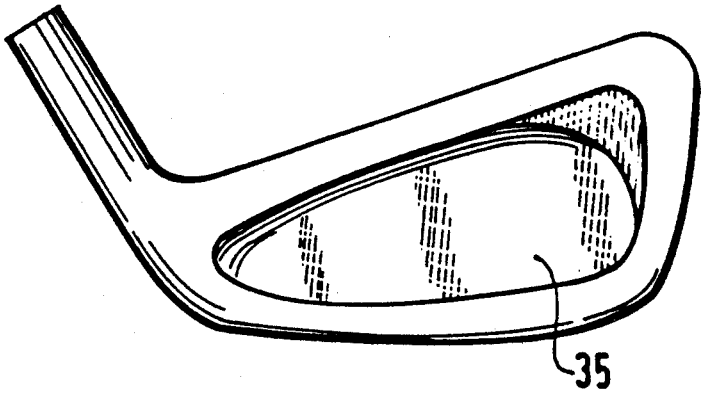
FIG. 16 PRIOR ART
FIG. 16 is a view of the rear face of the head of a typical perimeter-weighted iron having a large cavity 35 in its rear face according to Concept D.

To conceal the apertures of the cavities for aesthetic reasons, the rear face of the head can be flat as shown in FIGS. 13 and 14 and the cavities can be closed with a small molded part 32 having at least one cylinder 31 provided to enter at least one cavity 30 to facilitate adjustment by bonding of said small part to the head. In this case, it is preferred to mold the small part 32 with the kind of high damping polymer mentioned above. With such heads, the length of shots obtained was surprisingly even greater than with heads shown in FIGS. 9–12, with less vibrations and the same good sound.

With larger heads it is possible to obtain, using larger diameter cavities, the same weight down to 198.5 g., as long as the shape of said larger heads is high enough in the rear face for larger apertures and long enough from heel to toe to keep the cavities in the central part of the head, for a good balance, while having also enough space between cavities to permit large enough partitions to strengthen the face.

Figure 17:
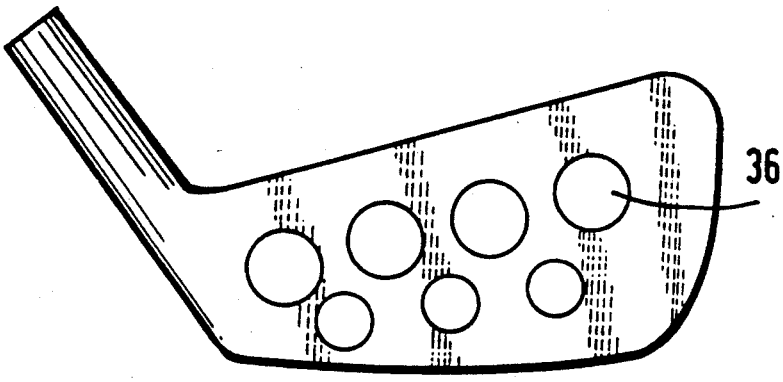
FIG. 17 is a view of the rear face of the head of a typical iron having 7 cavities 36 according to Concept F.
Figure 18:
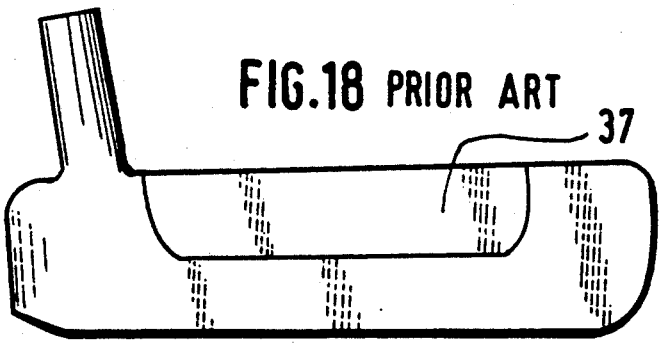
FIG. 18 PRIOR ART
FIG. 18 is a view of the rear face of a commercial prior art putter having a large cavity 37 in its rear face, according to Concept D.
Figure 19:
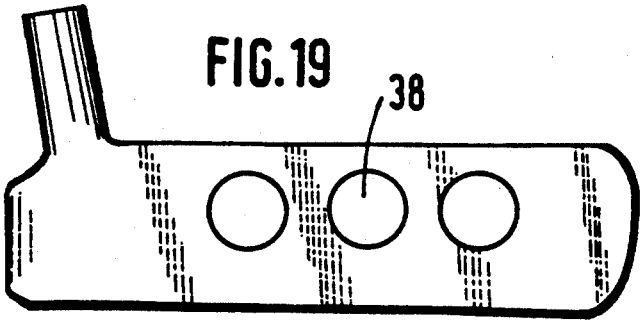
FIG. 19 is a view of the rear face of a putter having a blade similar to that of FIG. 18 and three cavities 38 according to Concept F.

The performance of irons and putters with molded metal heads, as shown in FIGS. 17 and 19, is improved by the same means as those described for driver heads. Holes are pierced in the wall of the rear portion of the mold. The axes of these holes, which are the same as the axes of the cylinders introduced in said holes, and of the cavities created as well as the partitions between the cavities, are all parallel in the same direction as the direction of the stroke.

By adjusting the lengths of the various cylinders and thus of the cavities they create, in accordance with the invention, it is possible to mold heads having a desired weight and also a weight distribution which can be controlled as desired to improve off-center hits, or to create a desired trajectory.

Figure 20:
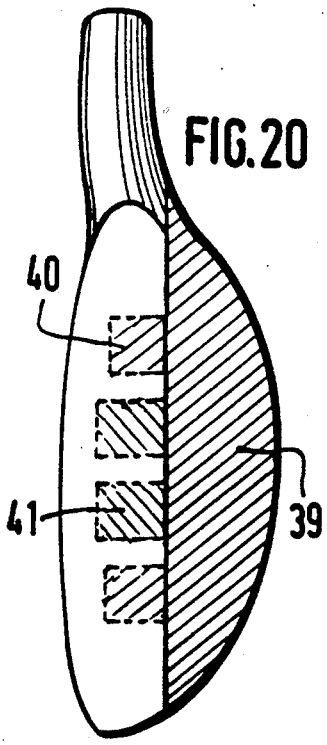
FIG. 20 is a view of the sole of a long iron having its rear face extended by a small molded part 39 provided with two small cylinders 40 entering two cavities in the head, other cavities 41 being filled with polyethylene foam.

In an embodiment similar to that shown in FIGS. 13 and 14, it is possible to close the cavities of an iron head with a molded polyurethane piece 39 fitted and bonded to the flat rear face thereof (FIG. 20), said piece having one or more small cylinders 40 which enter and fill entirely some apertures in the rear face of the iron head. The remaining holes, if any, e.g., 41, can be filled if desired with some other appropriate material, e.g., a light foam. With such a molded piece 39, especially if a polymer having high damping properties is used, some iron heads will produce increased length with low vibrations, and improved control and sound. It is therefore possible that, with adequate degrees of loft, roll, and bulge on the front face and proper types and lengths of shaft, such heads can be used with woods as well as long irons. Similarly, a molded piece bonded to the rear face of a putter will also improve the control and accuracy of the club.

Figure 15:
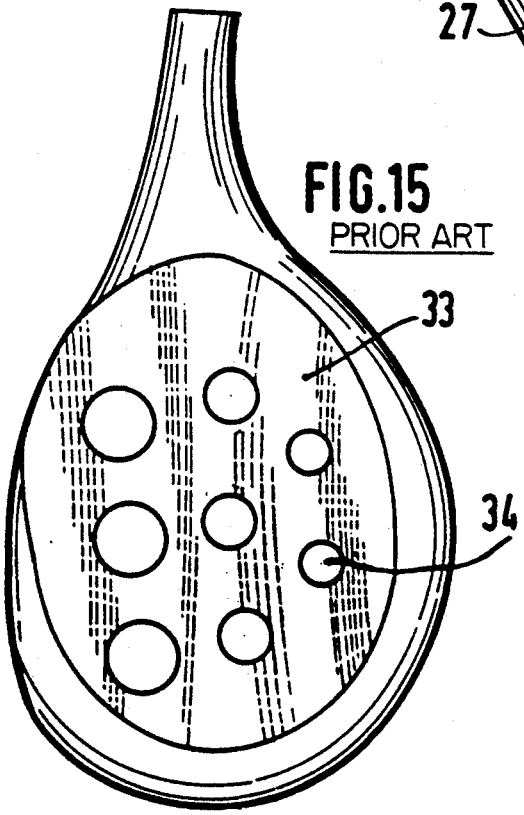
FIG. 15 PRIOR ART
FIG. 15 is a view of the sole 33 of a prior art head showing the apertures of 8 vertical cavities 34 pierced in its sole 33.

Clubs having heads produced in accordance with the invention were compared with conventional clubs in actual play by expert golfers. The conventional clubs involved in the tests included drivers having wooden, plastic, or metal heads, and steel or graphite shafts, and a long iron (No. 3) having a peripheral weighted head. The tests also included a driver having a molded head including vertical cavities extending upwardly from the sole, as shown in FIG. 15. In each case, a club of the prior art was matched against a club having a head in accordance with the invention. The matching clubs were substantially identical in total weight, swing weight, and shaft length and composition.

The tests were conducted by two expert professional golf champions, having substantial experience in playing, as well as teaching, golf and the use of golfing equipment.

The results of the tests showed that in comparison with the conventional heads which were tested, the heads of the invention produced shots which were generally consistently straighter, especially for off-center hits, and longer, even when used in a club having a slightly lower swingweight than that of the conventional club. In addition, the heads of the invention produced a sound on striking the ball similar to that produced by wooden, especially persimmon, heads.

In comparison with the head shown in FIG. 15, having vertical cavities in its sole, the head of the invention produced much greater length and much less vibration, indicating that the restitution of energy using the head of FIG. 15 is very poor.

The tests with iron clubs showed that the clubs of the invention were relatively free of the vibration often felt with peripheral-weighted iron clubs. Slightly more length with a more solid impact and a better sound were obtained with the heads of the invention.

The foregoing detailed description has been given for clearness of understanding only, and no unnecessary limitations should be understood therefrom, as modifications will be obvious to those skilled in the art.

What is claimed is:

1. A method of manufacturing a golf club head of predetermined shape and volume having a sole, a top face, a homogeneous front face for striking a golf ball and a rear face opposite said front face, said method creating cavities reducing the weight of said head to a predetermined extent without changing its shape and volume, said method comprising:

providing a mold having front and rear portions corresponding to front and rear faces of said head, introducing at least two elements into the interior of said mold through apertures in said rear portion, each said element projecting into said mold a determined distance less than the distance between said rear and front faces, introducing a hardenable material into said mold and around said projecting elements to achieve a predetermined head shape, hardening said material to produce a molded head, withdrawing said projecting elements from said material to leave at least two said cavities of predetermined length in said head, and removing said molded head from the mold.

2. A method in accordance with claim 1 in which said elements are cylinders, the axes of said cylinders being parallel and included in planes perpendicular to a horizontal tangent to the center of said front face, said planes being oriented in the same direction as a player stroke, the partition or partitions between said cavities extending between said rear face and said front face of said head, and being oriented in the same direction as said stroke, whereby said front face is strengthened to reduce vibrations and to obtain a high level of restitution of energy and a good sound when a ball is struck by said head.

3. A method in accordance with claim 2 in which said axes are positioned between the heel and the toe of said head in a manner which fixes the center of gravity of said head at a desired point behind said front face of said head.

4. A method as claimed in claim 2 in which said cylinders are introduced into said mold by means of a block separated from said mold, to which the ends of said cylinders are attached, permitting said cylinders to be simultaneously inserted into or withdrawn from said mold.

5. A method in accordance with claim 2 in which the head is a driver head and in which said cavity axes are positioned in said planes in a manner which leaves a greater height of said material between the ends of said cavities behind said front face and the sole of said head than between said ends and the top face of said head.

6. A method in accordance with claim 5 in which said ends of said cavities end between 0.5 and 1 cm from said top face of said head and between 1 and 1.5 cm from said front face of said head with a separator of at least 0.4 cm between them.

7. A method in accordance with claim 5 in which, after molding, said cavities are partly filled with light damping foam.

8. A method in accordance with claim 7 in which the apertures of cavities in the rear face of said head are closed with self-bonding material having a density approximately the density of said hardenable material.

9. A method in accordance with claim 7 in which said driver cavities are closed by hardened cylinders of said hardenable material.

10. A method in accordance with claim 8 in which the weight of and golf club head is controlled in part by the proportion in said cavities between the length of said light damping foam and the length of said self-bonding material.

11. A method in accordance with claim 9 in which the weight of said golf club head is controlled in part by the proportion in said cavities between the length of said light foam and the length of said cylinders.

12. A method in accordance with claim 9 in which at least one of said hardened cylinders is a part of a molded piece bonded to said head and concealing the apertures of said cavities.

13. A method in accordance with claim 12 in which the material of said hardened cylinder and said piece has high damping properties.

14. A method in accordance with claim 1 in which said golf club head is a driver head and said hardenable material is a polyurethane polymer.

15. A method in accordance with claim 4 in which said golf club head is an iron or a putter head and said cavities are filled and closed by self-bonding material.

16. A method in accordance with claim 4 in which said golf club head is an iron or putter head, at least one cavity being filled by a cylinder which is part of a piece of polyurethane polymer bonded to said head and concealing the apertures of said cavities.

17. A method in accordance with claim 16 in which said cylinder and piece bonded to an iron head are extended and rounded, permitting such head to be used as a "wood" head, as well as an iron head, with proper weight, face characteristics and type of shaft.

18. A method in accordance with claim 16 in which said polyurethane polymer of said cylinder and piece has high damping properties.

* * * * *